US010660360B2

(12) United States Patent
Fallon

(10) Patent No.: US 10,660,360 B2
(45) Date of Patent: May 26, 2020

(54) ROD ARTICLE DISTRIBUTION APPARATUS

(71) Applicant: British American Tobacco (Investments) Limited, London (GB)

(72) Inventor: Gary Fallon, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 283 days.

(21) Appl. No.: 15/523,430

(22) PCT Filed: Oct. 26, 2015

(86) PCT No.: PCT/GB2015/053198
§ 371 (c)(1),
(2) Date: May 1, 2017

(87) PCT Pub. No.: WO2016/067000
PCT Pub. Date: May 6, 2016

(65) Prior Publication Data

US 2017/0295841 A1 Oct. 19, 2017

(30) Foreign Application Priority Data

Oct. 29, 2014 (GB) ..... 1419197.7

(51) Int. Cl.
*A24C 5/32* (2006.01)
*A24C 5/18* (2006.01)
(Continued)

(52) U.S. Cl.
CPC ..... *A24C 5/327* (2013.01); *A24C 5/18* (2013.01); *B65B 19/10* (2013.01); *A24C 5/00* (2013.01); *B65B 19/00* (2013.01)

(58) Field of Classification Search
CPC ..... A24C 5/327; A24C 5/18
(Continued)

(56) References Cited

U.S. PATENT DOCUMENTS 3,715,056 A * 2/1973 Preston ..... A24C 5/325 221/211
4,714,082 A 12/1987 Banerjee et al.
(Continued)

FOREIGN PATENT DOCUMENTS

EP 0562474 A2 9/1993
EP 0589298 A1 3/1994
(Continued)

OTHER PUBLICATIONS

International Search Report for corresponding application PCT/GB2015/053198 filed Oct. 26, 2015; dated Feb. 11, 2016.
(Continued)

*Primary Examiner* — Eric Yaary
*Assistant Examiner* — Russell E Sparks
(74) *Attorney, Agent, or Firm* — Cantor Colburn LLP

(57) ABSTRACT

The present application relates to a rod article distribution apparatus (10) for distributing rod articles (50) between at least two storage columns. The apparatus (10) has a rod article infeed (20), a rod article distributor (30) having an epicyclic drum arrangement, and at least two rod article receiving channels (41). The rod article distributor (30) is configured to distribute rod articles (50) between the at least two rod article receiving channels (41). The present application also relates to a rod article making apparatus and a method of distributing rod articles between at least two storage columns.

9 Claims, 2 Drawing Sheets

(51) Int. Cl.

| | |
|---|---|
| ***B65B 19/10*** | (2006.01) |
| *A24C 5/00* | (2020.01) |
| *B65B 19/00* | (2006.01) |

(58) Field of Classification Search
USPC ..... 131/84.1
See application file for complete search history.

(56) References Cited

U.S. PATENT DOCUMENTS

| | | | | |
|---|---|---|---|---|
| 5,860,506 | A * | 1/1999 | Bailey | B65B 19/105 198/450 |
| 7,123,987 | B2 * | 10/2006 | Okamoto | A24C 5/327 700/213 |
| 7,171,796 | B2 * | 2/2007 | Spirito | B65B 19/10 53/151 |
| 2005/0077149 | A1 | 4/2005 | Wohltmann | |

FOREIGN PATENT DOCUMENTS

| | | | |
|---|---|---|---|
| EP | 0599162 | A1 | 6/1994 |
| EP | 0720822 | A2 | 7/1996 |
| EP | 839718 | A1 * | 5/1998 |
| EP | 0867127 | A1 | 9/1998 |
| EP | 0882412 | A2 | 12/1998 |
| EP | 1561386 | A1 | 8/2005 |
| EP | 1935813 | A1 | 6/2008 |
| EP | 2363029 | A1 | 9/2011 |
| RU | 2346630 | C2 | 1/2006 |
| RU | 2445905 | C2 | 11/2010 |
| WO | 9521771 | A1 | 8/1995 |

OTHER PUBLICATIONS

Written Opinion for corresponding application PCT/GB2015/053198 filed Oct. 26, 2015; dated Feb. 11, 2016.
Russian Search Report for corresponding application 18 113 11M-2011; dated May 30, 2015.

* cited by examiner

ROD ARTICLE DISTRIBUTION APPARATUS

FIELD OF THE INVENTION

The present invention relates to a rod article distribution apparatus. The present invention also relates to a rod article making apparatus and a method of distributing rod articles between at least two storage columns.

BACKGROUND

During the manufacture of fragile rod articles, it is known to pass them along a conveyor drum arrangement. However, it is known to be difficult to remove them from a high-speed manufacturing path without causing damage to the rod articles. Furthermore, such rod articles need to be distributed for storage without creating defects in the rod articles.

SUMMARY

According to one aspect of the present invention there is provided a rod article distribution apparatus for distributing rod articles between at least two storage columns comprising a rod article infeed, a rod article distributor having an epicyclic drum arrangement, and at least two rod article receiving channels, the rod article distributor being configured to distribute rod articles between the at least two rod article receiving channels.

The rod article distributer may be configured to drop rod articles into each of the at least two rod receiving channels.

The at least two rod receiving channels may form a rod article transfer feed configured to align and feed rod articles into corresponding at least two storage columns of a rod storage unit.

The rod article distribution apparatus may further comprise a rod storage unit having at least two storage columns, wherein the pitch of the at least two storage columns of the rod storage unit corresponds to the pitch of the at least two rod receiving channels.

The rod receiving channels may extend substantially parallel to each other.

The epicyclic drum arrangement may comprise a sun drum, a rotational annular carrier around the sun drum, the annular carrier and the sun drum being rotatable about a common axis, and planetary drums rotatable about their own axis, the planetary drums being on the rotational annular carrier.

The sun drum may rotate at a higher speed than the annular carrier.

The planetary drums may have a tangential speed that equals a tangential speed of the carrier.

The sun drum may comprise an outer circumferential surface formed with grooves for receiving rod articles and the grooves may be evenly spaced apart from one another in a direction about the common axis.

The rod article infeed may comprise an infeed drum configured to supply rod articles to the sun drum.

The sun drum may comprise a cam arrangement so as to enable rod articles to be received by the sun drum from the rod article infeed.

The sun drum may comprise segments movable relative to one another in a direction parallel to the common axis.

The segments may be movable relative to one another so as to enable rod articles to be received by the sun drum from the rod article infeed.

The rod article distributor may be configured to pass rod articles along a path so that the longitudinal axis of each rod article is aligned substantially vertically.

According to another aspect of the present invention, there is provided a rod article making apparatus comprising a rod article distribution apparatus according to any of the claims.

According to another aspect of the present invention, there is provided a method of distributing rod articles between at least two storage columns, comprising distributing rod articles from a rod article infeed between at least two rod article receiving channels using a rod article distributor having an epicyclic drum arrangement.

The method may further comprise picking up rod articles on a sun drum of the epicyclic drum arrangement, and using planetary drums of the epicyclic drum arrangement to decelerate the rod articles to allow them to be dropped into each of the at least two rod receiving channels.

The method may further comprise rotating the planetary drums about their own axis and about an axis of a carrier supporting the planetary drums, and rotating the sun drum at a speed higher than the rotational speed of the carrier.

BRIEF DESCRIPTION OF THE DRAWINGS

Embodiments of the invention will now be described, by way of example only, with reference to the accompanying drawings in which.

DETAILED DESCRIPTION

Figure 1:
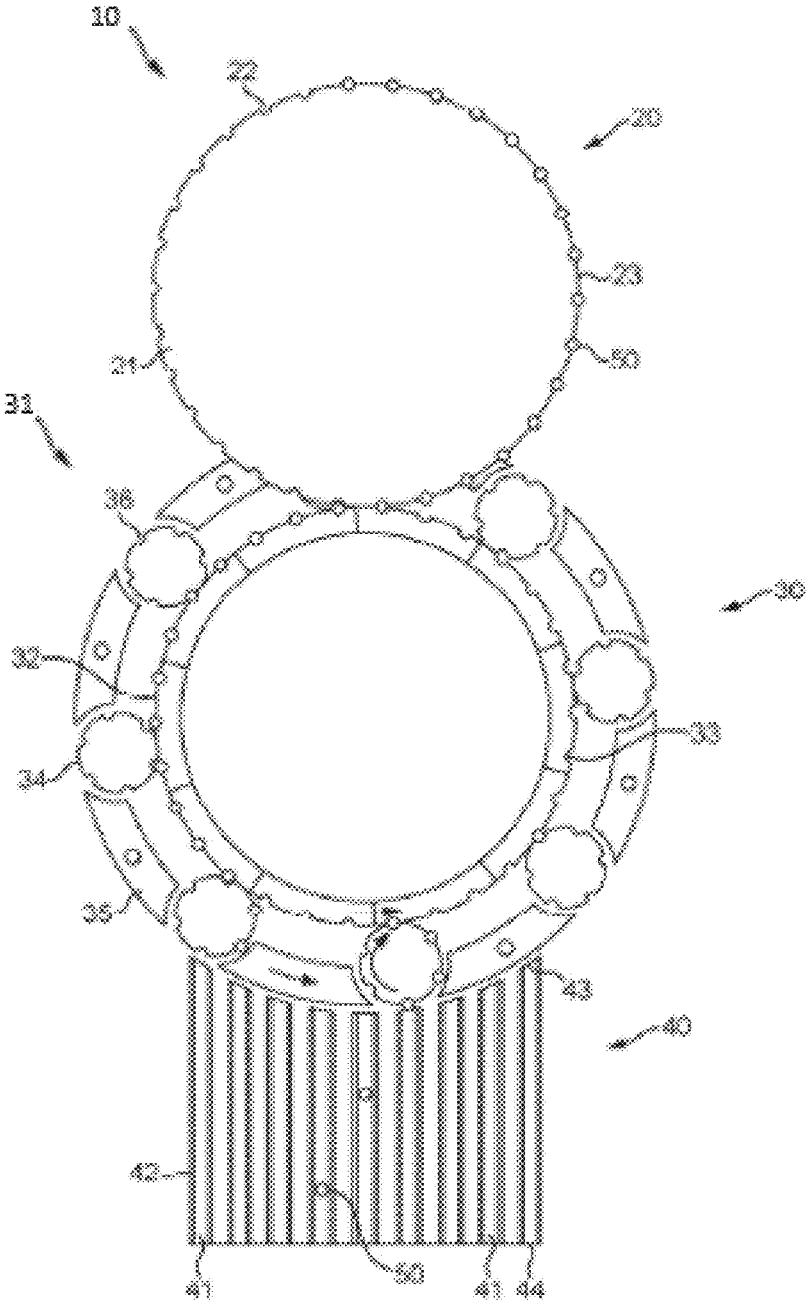
FIG. 1 is a front view of a part of a rod article distribution apparatus according to the present invention.

Referring now to the drawings, FIG. 1 shows a part of a rod article distribution apparatus 10. The rod article distribution apparatus 10 comprises a rod article infeed 20, a rod article distributor 30, and a rod article transfer feed 40.

The rod article distributor 30 has an epicyclic drum arrangement 31. The rod article distributor 30 is used for transferring rod articles towards a subsequent storage stage where rod articles 50 can be stored. The rod article distribution apparatus 30 defines a rod article distribution path. The rod article distribution apparatus 10 is usable with fragile and/or brittle rod articles 50, such as those formed from or including glass. Rod articles 50 are elongate cylindrical articles, typically having a diameter of less than or equal to 10 mm. The rod articles have a longitudinal axis.

The rod articles 50 may be elements forming a tobacco industry product or forming part of a tobacco industry product. A tobacco industry product refers to any item made in, or sold by the tobacco industry, typically including a) cigarettes, cigarillos, cigars, tobacco for pipes or for roll-your-own cigarettes, (whether based on tobacco, tobacco derivatives, expanded tobacco, reconstituted tobacco or tobacco substitutes); b) non-smoking products incorporating tobacco, tobacco derivatives, expanded tobacco, reconstituted tobacco or tobacco substitutes such as snuff, snus, hard tobacco, and tobacco heating devices including those tobacco heating devices in which glass fibre is wrapped around a charcoal element; and c) other nicotine-delivery systems such as inhalers, aerosol generation devices including e-cigarettes, lozenges and gum. This list is not intended to be exclusive, but merely illustrates a range of products which are made and sold in the tobacco industry.

In particular, the rod articles 50 may be elements forming a smoking article or forming part of a smoking article. Rod articles 50 forming part of a smoking article may be elements for inclusion in a filter, in a tobacco rod, or in another part of the smoking article. As used herein, the term "smoking article" includes smokeable products such as cigarettes, cigars and cigarillos whether based on tobacco, tobacco derivatives, expanded tobacco, reconstituted tobacco or tobacco substitutes and also tobacco heating devices and other nicotine delivery product such as aerosol generation devices including e-cigarettes. The smoking article may be provided with a filter for the gaseous flow drawn by the smoker.

The rod articles 50 may be formed from different materials, or a combination of materials, for example glass, ceramic, and carbon.

The rod article infeed 20 comprises an infeed drum 21. The infeed drum 21 is a rotatable drum, also known as a roller. The infeed drum 21 is rotatable about a central axis. The infeed drum 21 is fed rod articles 50 by known means. For example, the infeed drum 21 may be supplied rod articles 50 from a cons ever drum arrangement (not shown). The conveyor drum arrangement may enable the manufacture of rod articles 50.

The infeed drum 21 comprises a number of grooves 22 for receiving rod articles 50. The grooves 22 extend axially on an outer circumferential surface 23 of the infeed drum 21. The rod articles 50 are held in the grooves 22 by negative air pressure. The rod articles 50 are released from the grooves 22 by removing the negative air pressure or by applying a positive air pressure. The air pressure differential is applied through one or more air vents (not shown) at the surface of the grooves 22.

The infeed drum 21 causes rod articles 50 received in grooves 22 to travel in a direction transverse to their longitudinal axis. That is, the rod articles 50 move in a direction which is perpendicular or substantially perpendicular to their longitudinal axis. The grooves 23 are evenly spaced apart from one another in a direction about the central axis.

The rod article infeed 20 conveys the rod articles 50 to the rod article distributer 30. Although in the present embodiment the rod article infeed 20 is the infeed drum 21, it should be understood that alternative arrangements are possible. In an alternative embodiment, the rod article infeed 20 comprises a conveyor belt or other means for transporting the rod articles to the rod article distributer 30. The rod article infeed 20 transfers the rod articles 50 from the conveyor drum arrangement (not shown) to the rod article distributer 30. That is, the point at which they are received from the conveyor drum arrangement to a point at which the infeed drum 21 meets a sun drum 32 of the epicyclic drum arrangement 30. At this point, the rod articles 50 on the infeed drum 21 are fed into corresponding grooves 33 of the sun drum 32.

The epicyclic drum arrangement 31 comprises the sun drum 32, planetary drums 34, and a rotatable annular carrier 35. The sun drum 32 forms a central drum. The planetary drums 34 are disposed in a circumferential arrangement around the sun drum 32. The planetary drums 34 are supported by the carrier 35. The carrier 35 is rotatable about a central axis. The sun drum 32 is disposed within the carrier 35 and is rotatable about the same common axis as the carrier 35.

A circumferential outer surface of the sun drum 32 is facing an inner surface of the carrier 35. The circumferential outer surface of the sun drum 32 is formed with the grooves 33 extending parallel to the common axis about which the sun drum 32 is rotatable. In the particular embodiment shown in FIG. 1, the circumferential outer surface of the sun drum 32 is formed with thirty grooves 33. The number of grooves 33 may differ. Each groove 33 may carry a single rod article 50. The rod articles 50 are held in the grooves 33 by suction being applied to the rod articles 50 through valve-operated holes (not shown) formed at the grooves 33. The thirty grooves 33 are equally spaced apart from one another in a rotational direction about the common axis.

However this arrangement is optional, as in an alternative embodiment the grooves 33 are formed into groups such that the outer surface of the sun drum 32 is formed with a single or multiple group(s) of grooves.

In the embodiment shown in the figures, there are eight planetary drums 34 supported by a rotatable annular carrier 35. Although eight planetary drums 34 are shown, it should be understood that the number of planetary drums 34 may differ. Each planetary drum 34 is rotatable about their own central axis in a clockwise direction, and the carrier 35 is rotated about its central axis in an anti-clockwise direction. Each planetary drum 34 has six grooves 36 and each groove 36 is configured to receive at least one rod article 50 from one of the corresponding grooves 22 on the sun drum 32. The number of grooves 36 may differ. The grooves 36 on each planetary drum 34 are equally spaced apart from one another in a rotational direction about the planetary drum's central axis. The spacing of the grooves 36 on each planetary drum 34 corresponds to the spacing of the grooves 33 on the sun drum 32. The rod articles 50 are held in the grooves 36 by suction being applied to the rod articles 50 through valve-operated holes (not shown) formed in the grooves 36.

The rod article transfer feed 40 comprises nine channels 41. The channels 41 are spaced from each other. The channels 41 are formed by vanes 42. The channels 42 are configured to allow rod articles 50 to pass therealong. Each channel 41 has a width corresponding to one rod article 50, however this is optional. The channels 42 are elongate and are arranged to extend vertically. Each channel 42 has an inlet 43. The inlet 43 is configured to received rod articles 50. The inlet 43 receives rod articles 50 from the rod article distributor 30. The rod article transfer feed 40 is disposed below the rod article distributor 30. That is, rod articles 50 carried by the rod article distributor 30 are able to fall to the rod article transfer feed 40. The inlet 43 of each channel 42 is configured to receive rod articles 50 from the grooves 36 on each planetary drum 34. Each channel 42 has an outlet 44. Each outlet 44 is configured to align with corresponding storage columns (not shown) of a rod storage unit (not shown). Rod storage units are positionable below the outlets 44 of the rod article transfer feed 40. The channels 41 are configured to feed rod articles 50 into the corresponding storage columns.

The rod storage units (not shown), also called trays, comprise opposing side walls (not shown) and dividers (not shown) extending between the side walls. The dividers define the storage columns. The storage columns extend parallel to each other. An upper end of the rod storage unit is open so as to be able to receive rod articles 50 therethrough. The pitch of the channels 41 of the rod article transfer feed 40 corresponds to the pitch of the storage columns of the rod storage units. Therefore, the channels 41 of the rod article transfer feed 40 are alignable with the storage columns of the rod storage units. When one of the rod articles 50 is fed from the outlet 44 of one of the channels 42 it is receivable in a corresponding storage column aligned therewith.

Rod articles 50 are transferred from the grooves 22 on the infeed drum 21 onto the grooves 33 of the sun drum 32, and then onto the grooves 36 of the planetary drums 34. The rod articles 50 are then transferred to the channels 41 of the rod article transfer feed 40. The tangential speed of the sun drum 32 corresponds to the tangential speed of the infeed drum 21. The infeed drum 21 rotates in a clockwise direction. The sun drum 32 rotates in an anti-clockwise direction. The sun drum 32 is continuously supplied with rod articles 50 from the infeed drum 21.

The rotation of the planetary drums 34 as they rotate about their own axis corresponds to the rotation of the sun drum 32 such that rod articles 50 in the grooves 33 of the sun drum 32 are transferred to the grooves 36 of the planetary drums 34. The sun drum 32 is configured to rotate at a higher angular speed than the carrier 33. The tangential speed of the planetary drums 36 as they rotate about their own axis equals the tangential speed of the carrier 35 rotating in the opposite direction such that a rod article 50 is released and falls into one of inlets 43 of the channels 41. Therefore, rod articles 50 are transferred from a high tangential speed along a rotational path to a reduced speed along a linear path. Therefore, the rod articles 50 are decelerated. The rod articles 50 then pass along the channels 41 and into corresponding storage columns (not shown) of the rod storage unit (not shown). It should be understood that the valves of the holes formed in the grooves 22, 33, 36 of the infeed drum 21, sun drum 32 and planetary drums 34 are operated such that vacuum is applied at the correct rotational position so as to allow for rod articles 50 to be picked up, transferred and released as described above.

The rod article distribution apparatus 10 may be supported by a single support, or alternatively, the components of the rod article distribution apparatus 10 may be supported on several separate supports. The rod article transfer feed 40 is not limited to comprising nine channels 41. It should be understood that the size of each component, the number of channels, planetary drums and their grooves, as well as the number of grooves on the sun drum can be varied so as to suit the desired distribution rate of rod articles, as well as the size of the rod articles being distributed.

The planetary drums 34, carrier 35 and sun drum 32, are operated by a set of gears and shafts (not shown) driven by a driver, such as a motor (not shown). Various gearing/driving arrangements will be evident to those skilled in the art. The rotational movement of the planetary drums 34 as the planetary drums 34 are being rotated by the carrier 35 can be described as an epicyclic motion. In one embodiment, the planetary drums 34, carrier 35 and the sun drum 32 are rotated in the opposite direction to that described above such that the planetary drums 34 have an epicyclic motion in the opposite direction about the common axis.

Figure 2:
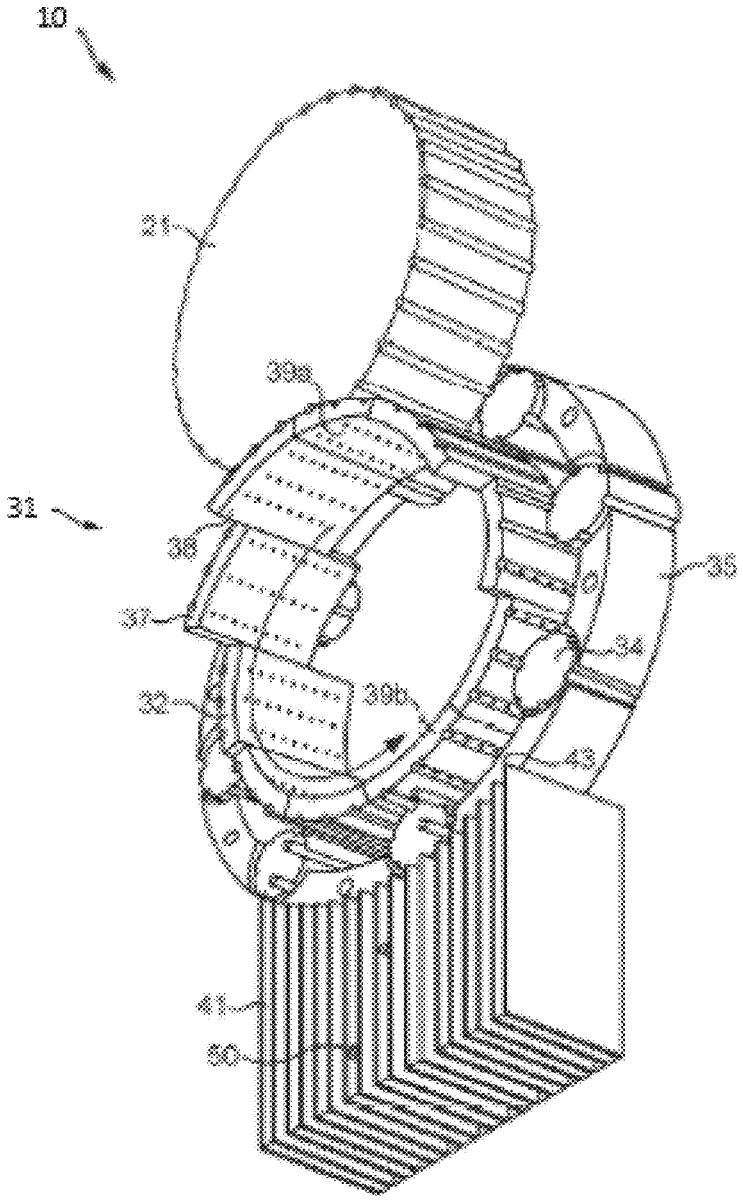
FIG. 2 is a perspective view of the rod article distribution apparatus shown in FIG. 1.

Referring now to FIG. 2, the sun drum 32 comprises a cam arrangement 37 configured to provide alignment of rod articles 50 on the infeed drum 32 with grooves 33 of the sun drum 32 so that rod articles 50 on the infeed drum 32 can be transferred to the sun drum 32. In the present embodiment a barrel cam arrangement is used however, it should be understood that alternative arrangements may be used to provide for a similar motion, for example a plate cam arrangement.

In the present arrangement, the sun drum 32 comprises movable segments 38 supported by a stationary barrel (not shown). The barrel is omitted from the Figures so that the segments 38 can be clearly shown. An outer circumferential surface of the barrel is formed with a barrel cam which cooperates with a corresponding cam or track formed on an inner surface of the segments 38 facing the circumferential surface of the barrel. The segments 38 are supported by two ring structures (not shown) located at the end of the segments 38 such that the segments 38 are sandwiched in between the ring structures. The ring structures are formed with pins which locate in holes of the segments. The ring structures are configured to rotate about the common axis and as their pins locate in the segments 38, the segments 38 rotate with the ring structures about said common. The barrel cam cooperating with the cam or track on the inner surface of the segments causes the segments 38 to move relative to one another in a direction parallel to the common axis of the sun drum 32 as the ring structures and the segments 38 are rotated about the barrel. As the segments 38 are rotated about the barrel, the segments 38 are moved from a pick-up position 39*a* to a drop-off position 39*b*. The segments 38 are in the pick-up position 39*a* when they are proximal to the infeed drum 21, and in the drop-off position 39*b* when they are proximal to the rod article transfer feed 4. The movable segments 38 of the sun drum 32 enables rod articles 50 to be transferred from the infeed drum 21 to the sun drum 32 without the interference of the carrier 35 and/or the planetary drums 34. In particular, the movable segments 38 enable the infeed drum 21 to overlap with the carrier 35 such that the infeed drum 21 engages the sun drum 32.

Operation of the rod article distribution apparatus 10 will now be described in greater detail. The carrier 35 rotates in an anti-clockwise direction and a first planetary drum 34 approaches the set of nine channels 41. As the first planetary drum 34 rotates about its own axis in a clockwise direction rod articles 50 held in the grooves 33 of the sun drum 32 are transferred to the first planetary drum 34 such that a rod article 50 locates in each groove 36 of the first planetary drum 34. As the first planetary drum 34 rotates at a high rotational speed to pick up rod articles 50 it simultaneously drops off rod articles 50 that are aligned with one of the corresponding channels 41 of the rod article transfer feed 40. As the planetary drums 34 are following an orbital path about the common axis, due to rotation of the carrier 35, the rod articles 50 are decelerated and drop into respective channel 41 upon release from the groove 36. As there are nine channels 41, and each planetary drum 34 has six grooves 36, each planetary drum 34 transfers nine rod articles 50 to the rod article transfer feed 40 per rotation of the carrier 35. Thus, the first three grooves 36 of each planetary drum 34 transfer two rod articles 50 in one rotation. The rod articles 50 are then guided by the channels 41 into the corresponding storage columns (not shown) of the rod storage unit (not shown). With this arrangement it is possible to distribute rod articles 50 between multiple storage columns (not shown). This distribution may occur at a rapid pace without exerting a large force on each rod article 50 which may result in damage to the rod articles 50. Furthermore, the epicyclic drum arrangement provides for the rod articles 50 to be rapidly decelerated to a stationary condition from the rotational speed of the infeed drum 21.

In the above described embodiment, the epicyclic drum arrangement 31 is configured to pass rod articles 50 along the rod article distribution path in which the longitudinal axis of each rod article is aligned substantially horizontal as the rod articles 50 pass along the rod article distribution path. With this embodiment, rod articles are fed from each planetary drum 34 to one of the corresponding channels 41 of the rod article transfer feed 40 under gravity. However, it will be understood that the alignment of the epicyclic drum arrangement may differ. For example, in another embodiment, the epicyclic drum arrangement 31 is configured to pass rod articles 50 along a rod article distribution path in which the longitudinal axis of each rod article 50 is aligned substantially vertical as the rod articles 50 pass along the rod article distribution path. In such an embodiment, the rod articles 50 may be transferred to the corresponding channels 41 of the rod article transfer feed 40 using an urging element (not shown). Such an urging element, may include a biasing finger which acts to flick the rod article from it's groove 36 into one of the corresponding channels 41.

In order to address various issues and advance the art, the entirety of this disclosure shows by way of illustration various embodiments in which the claimed invention(s) may be practiced and provide for a superior rod article distribution apparatus. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A rod article distribution apparatus for distributing rod articles between at least two storage columns comprising:

a rod article infeed, a rod article distributor having an epicyclic drum arrangement comprising a sun drum and planetary drums disposed circumferentially around the sun drum, and at least two rod article receiving channels, the epicyclic drum arrangement being configured so that upon rotation of the sun drum and the planetary drums, rod articles transferred from the rod article infeed onto the sun drum are transferred from the sun drum onto the planetary drums from which the rod articles are distributed between the at least two rod article receiving channels, wherein the at least two rod article receiving channels form a rod article transfer feed configured to align and feed the rod articles.

2. The rod article distribution apparatus according to claim 1, wherein the rod article distributor is configured to drop the rod articles into each of the at least two rod receiving channels.

3. The rod article distribution apparatus according to claim 2, further comprising a rod storage unit having at least two storage columns, wherein the pitch of the at least two storage columns of the rod storage unit corresponds to the pitch of the at least two rod receiving channels.

4. The rod article distribution apparatus according to claim 1, wherein the epicyclic drum arrangement comprises a sun drum, a rotational annular carrier around the sun drum, the annular carrier and the sun drum being rotatable about a common axis, and planetary drums rotatable about their own axes, the planetary drums being on the rotational annular carrier.

5. The rod article distribution apparatus according to claim 4, wherein the sun drum rotates at a higher speed than the annular carrier.

6. The rod article distribution apparatus according to claim 4, wherein the planetary drums have a tangential speed that equals a tangential speed of the carrier.

7. The rod article distribution apparatus according to claim 5, wherein the sun drum comprises an outer circumferential surface formed with grooves for receiving rod articles and the grooves are evenly spaced apart from one another in a direction about the common axis.

8. The rod article distribution apparatus according to claim 5, wherein the rod article infeed comprises an infeed drum configured to supply rod articles to the sun drum.

9. The rod article distribution apparatus according to claim 4, wherein the sun drum comprises a cam arrangement so as to enable rod articles to be received by the sun drum from the rod article infeed.

* * * * *